US010125952B2

(12) United States Patent
Fuller et al.

(10) Patent No.: US 10,125,952 B2
(45) Date of Patent: Nov. 13, 2018

(54) COLORED WATER DISPLAY

(71) Applicant: WET, Sun Valley, CA (US)

(72) Inventors: Mark Fuller, Sun Valley, CA (US); Jim Doyle, Sun Valley, CA (US); John Canavan, Sun Valley, CA (US)

(73) Assignee: WET, Sun Valley, CA (US)

( * ) Notice: Subject to any disclaimer, the term of this patent is extended or adjusted under 35 U.S.C. 154(b) by 0 days.

(21) Appl. No.: 14/211,301

(22) Filed: Mar. 14, 2014

(65) Prior Publication Data

US 2014/0268680 A1 Sep. 18, 2014

Related U.S. Application Data

(60) Provisional application No. 61/800,700, filed on Mar. 15, 2013.

(51) Int. Cl.

| | |
|---|---|
| ***F21V 33/00*** | (2006.01) |
| ***F21V 13/08*** | (2006.01) |
| ***F21S 11/00*** | (2006.01) |
| ***F21V 9/08*** | (2018.01) |
| *F21V 17/02* | (2006.01) |
| *F21V 7/00* | (2006.01) |
| *F21W 121/02* | (2006.01) |

(52) U.S. Cl.

CPC ..... *F21V 13/08* (2013.01); *F21S 11/005* (2013.01); *F21V 9/08* (2013.01); *F21V 7/0033* (2013.01); *F21V 17/02* (2013.01); *F21W 2121/02* (2013.01)

(58) Field of Classification Search

CPC ..... F21V 13/08

USPC ..... 362/101

See application file for complete search history.

(56) References Cited

U.S. PATENT DOCUMENTS

| | | | | |
|---|---|---|---|---|
| 3,088,675 | A * | 5/1963 | Bone | 239/20 |
| 3,894,689 | A * | 7/1975 | Billingsley | F21S 8/00 239/18 |
| 4,246,477 | A * | 1/1981 | Latter | F21S 2/00 250/214 AL |
| 4,661,893 | A | 4/1987 | Robinson et al. | |

(Continued)

FOREIGN PATENT DOCUMENTS

| | | |
|---|---|---|
| DE | 93 09 328 U1 | 8/1993 |
| DE | 202 03 919 U1 | 6/2002 |

(Continued)

OTHER PUBLICATIONS

PCT, International Preliminary Report on Patentability, International Application No. PCT/US2014/027575, dated Sep. 15, 2015, 9 pages.

(Continued)

*Primary Examiner* — Anh Mai
*Assistant Examiner* — Matthew Peerce
(74) *Attorney, Agent, or Firm* — Maceiko IP

(57) ABSTRACT

A system that illuminates water in a water display in broad daylight is described. The system may include a color filter that directs a desired color or range of colors onto the water. The source of light may be the sun or an artificial light source. Where the light source is the sun, a heliostat may be included to track the sun and reflect sunlight to the color filter. Other reflecting mirrors may be included to provide a line of sight between the light source and water display being illuminated.

19 Claims, 18 Drawing Sheets

(56) References Cited

U.S. PATENT DOCUMENTS

| | | | | |
|---|---|---|---|---|
| 4,758,930 | A * | 7/1988 | Pomares | B60Q 1/0011 362/1 |
| 5,479,276 | A * | 12/1995 | Herbermann | B64D 47/02 349/112 |
| 6,030,108 | A | 2/2000 | Ishiharada et al. | |
| 6,203,173 | B1 | 3/2001 | Duff et al. | |
| 6,379,025 | B1 * | 4/2002 | Mateescu et al. | 362/293 |
| 6,798,154 | B1 * | 9/2004 | Sullivan et al. | 315/362 |
| 7,510,288 | B2 * | 3/2009 | Shin et al. | 362/2 |
| 7,906,750 | B2 | 3/2011 | Hickerson et al. | |
| 2004/0022071 | A1 | 2/2004 | Cheng et al. | |
| 2007/0139910 | A1 * | 6/2007 | Gosis et al. | 362/96 |
| 2008/0236568 | A1 * | 10/2008 | Hickerson | F24J 2/38 126/578 |
| 2009/0196043 | A1 * | 8/2009 | Calmes | 362/278 |
| 2010/0300510 | A1 * | 12/2010 | Goldman | F24J 2/16 136/246 |

FOREIGN PATENT DOCUMENTS

| | | | |
|---|---|---|---|
| DE | 10 2006 020 052 | A1 | 10/2007 |
| JP | 2002-168486 | | 6/2002 |
| JP | 201350599 | A * | 3/2013 |
| WO | WO 03/102668 | | 12/2003 |

OTHER PUBLICATIONS

PCT, International Search Report and Written Opinion, dated Jul. 24, 2014, 13 pages.

* cited by examiner

COLORED WATER DISPLAY

CROSS REFERENCE TO RELATED APPLICATION

The application claims the benefit of U.S. Provisional Application No. 61/800,700, filed Mar. 15, 2013, the contents of which are incorporated herein by reference.

FIELD OF THE INVENTION

The present invention generally relates to water displays, including water displays wherein the water may be illuminated with different colors using sunlight or artificial light.

BACKGROUND OF THE INVENTION

Various water displays exist where light may be used to illuminate the water with different colors. However, these displays typically illuminate the water only at night because it is difficult to illuminate water in broad daylight. And when illuminating water at night, artificial light sources must obviously be used since sunlight is not available.

Illuminating water displays using artificial light during the day may require very bright spotlights which may be expensive to operate on a continual basis because of the large energy consumption that spotlights of this nature may require. And if colored artificial light is used to illuminate the water during the day, the light providing the coloration is typically dispersed so as to provide little if any visually discernible illumination. Accordingly, there is a need for a water display where the water may be illuminated during the day. There is a further need to use sunlight as the light source used to illuminate water.

Certain water displays may be situated so that they are generally blocked from the sun. For example, such water displays may be located at the base of one or more tall buildings that may block sunlight from reaching the water display. Accordingly, there is a need for a system to redirect sunlight or artificial light onto water to provide illumination during the day.

SUMMARY OF THE INVENTION

In an aspect of the invention, a system for illuminating water during the daytime is described. To this end, sunlight or artificial light may be used. The system may include a reflector to redirect sunlight through one or more changeable color filters onto the water. Alternatively, artificial light may be directed through one or more changeable color filters. In either case, the color filters may comprise dichroic filters which preferably provide an intense beam of light to illuminate water with a certain color regardless of whether the light source is the sun or artificial.

In another aspect of the invention, the system may include a heliostat mirror that tracks the position of the sun throughout the day so that if the illumination is based on sunlight, the water display may be illuminated throughout the day. To this end, multiple heliostat mirrors may be used that are positioned to increase or maximize the sunlight that may be reflected at different times during the day.

In another aspect of the invention, the system may include one or more relay mirrors to direct sunlight or artificial light to a water display that may be in a secluded location. For example, a water display that is surrounded by tall buildings may benefit from having multiple reflectors.

In another aspect of the invention, filters that provide different colors may be used to illuminate the water. These filters may preferably provide intense colors that may be concentrated on the water so that the colors may be seen in the daylight. In this aspect of the invention, the filters may be dichroic filters that scatter relatively little light passing through the filter so that the transmitted light may intensely illuminate the water.

DETAILED DESCRIPTION OF THE PREFERRED EMBODIMENTS

Figure 1:
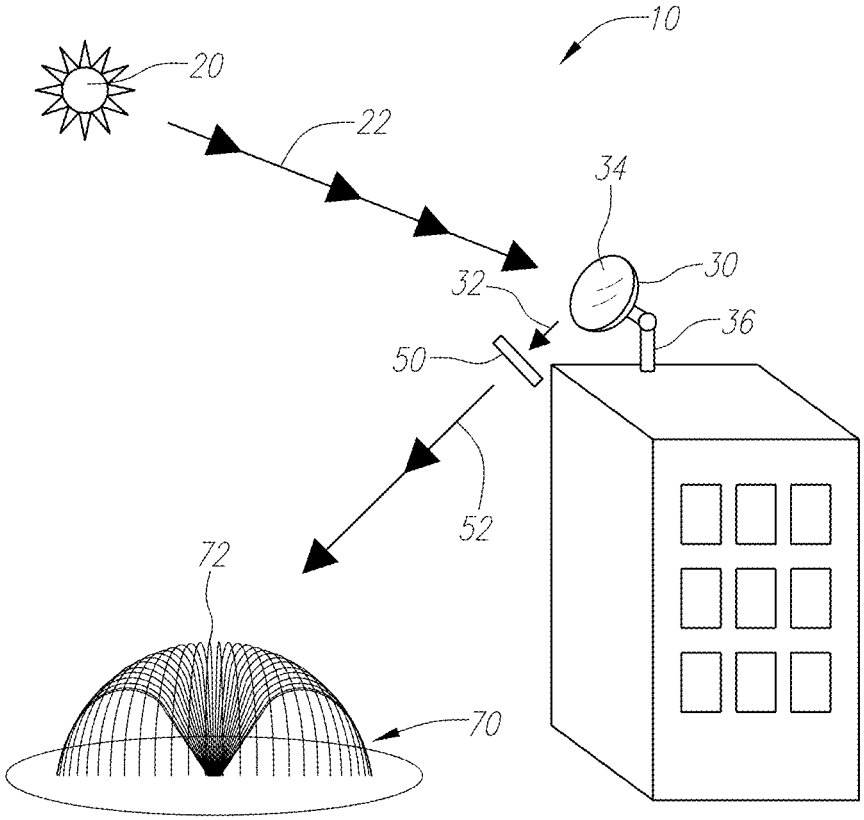
FIG. 1 is a system diagram of an embodiment of the current invention using sunlight, a heliostat and a color filter to illuminate a water display.

The current invention is now described with reference to the figures. Components appearing in more than one figure bear the same reference numerals. The current invention is described below with an emphasis on using sunlight as the source of illumination. However, it should be noted that artificial light may also be used, so the emphasis on sunlight should not be interpreted as a limitation on the scope of the invention.

A system 10 embodying the current invention is now described with reference to FIG. 1. As shown, the sun 20 may be the source of illumination for system 10. Sunlight 22 from the sun 20 may generally shine downward onto a heliostat 30 that may track the sun's position throughout the day or a part thereof in order to reflect and generally redirect the sunlight 22 onto a fixed target. The reflected sunlight 32 off of the heliostat 30 may be directed to a color filter 50. The reflected sunlight 32 may pass through the color filter 50 and become filtered light 52 which may exhibit a color of light other than white light. This filtered light 52 may then be directed onto a water display 70 where it may illuminate water 72.

Heliostat 30 may comprise of a mirror 34 that may be flat, such as a plane mirror. Accordingly, reflected sunlight 32 may reflect off the mirror 34 at a reflection angle that is equal to the incident angle of sunlight 22 directed onto the mirror 34 by the sun 20. Because sunlight 22 is collimated with parallel rays, and the mirror 34 may be planar, the reflected light 32 may remain collimated. This provides that most of the intensity of sunlight 22 is still available for system 10.

Heliostat 30 may also include a base 36 that allows the heliostat 30 to rotate and turn in most directions. The purpose of Heliostat 30 may be to track the apparent movement of the sun 20 across the sky and to rotate and turn its mirror 34 on base 36 in order to continuously reflect incident sunlight 22 onto color filter 50 as the line of sight of the sun 20 moves. To accomplish this, the heliostat 30 may continuously position itself such that the reflective surface of its mirror 34 is kept perpendicular to the bisector of the angle between the direction of the sun and the color filter 50 as seen from the mirror 34.

The position of mirror 34 of the heliostat 30 may be controlled by a computer or other controller. The computer may be given the latitude and longitude of the position of the heliostat 30 on the earth and the time and date. From this data, using astronomical theory, the computer may calculate the direction of the sun as seen from the mirror, e.g. its compass bearing and angle of elevation. Then, given the direction of the target water display 70, the computer may calculate the direction of the required angle-bisector, and send control signals to motors, often stepper motors, that may control the position of the heliostat 30 with instructions to turn the mirror to the correct alignment. This sequence of operations may be repeated frequently to keep the mirror properly oriented throughout the day or during a portion thereof.

System 10 may preferably illuminate water display 70 with intense beams of light so that one or more colors may be observed during the daytime. To this end, system 10 may take advantage of the fact that sunlight 22 is collimated and relatively intense. Heliostat 30 may be preferably of good quality so that the reflected light 32 may retain much of the intensity of sunlight 22 and may be highly focused onto color filter 50. It may also be preferred that heliostat 30 have a large enough surface area so that sufficient sunlight 22 becomes reflected light 32.

In a preferred embodiment, color filter 50 comprises a dichroic filter. This type of filter may be preferred because it may selectively pass certain wavelengths of light while reflecting others. This type of filter may also highly focus the light instead of letting it scatter. The end result may be an intense beam of light of a certain color or narrow range of colors that may be directed to water display 72. It is also preferred that the dichroic filter 50 be relatively large so that sufficient light may be directed through the filter 50 to illuminate the water 72 in water display 70.

In this manner, a comparatively bright beam of intense color may illuminate the water 72 of the display 70 such that the color may be discernible in broad daylight. More specifically, it is preferred that the colored light 52 from filter 50 be substantially brighter than the direct, white, incident sunlight falling onto the same water 72 area of display 70. As a result, the water 72 illuminated by the colored light 52 emitted by the color filter 50 may appear to be glowing or to be a phosphorescent liquid.

The specific color wavelength emitted by the color filter 50 may be generally fixed and pre-set such that the color filter 50 may only emit a particular color or a narrow range of colors. Conversely, the color filter 50 may be adjustable such that it may be adjusted to emit specifically desired colors or narrow ranges of colors. This adjustment of emitted colors may be made manually or may be controlled by a computer or other controlling device as described in later sections. It should also be noted that it may be preferable for color filters 50 to have the ability to close their output in order to essentially block any light from emitting onto the water display 70. This may be desired when the system 10 is not in operation and illumination of the water display 70 is not desired.

In addition, system 10 may include a multitude of different fixed color filters 50 that may be pre-set to emit different colors or different narrow ranges of colors. System 10 may also have the ability to switch which filter 50 is in-line with the reflected sunlight 32 in order to choose which color is emitted onto the water display 70. To accomplish this, a switching matrix, multiplexor or other switching means may be incorporated to switch different color filters 50 in and out of the path of reflected light 32 to produce a particular desired color. This switching may be manually controlled or may be under the control of a computer or other controlling means.

Figure 2:
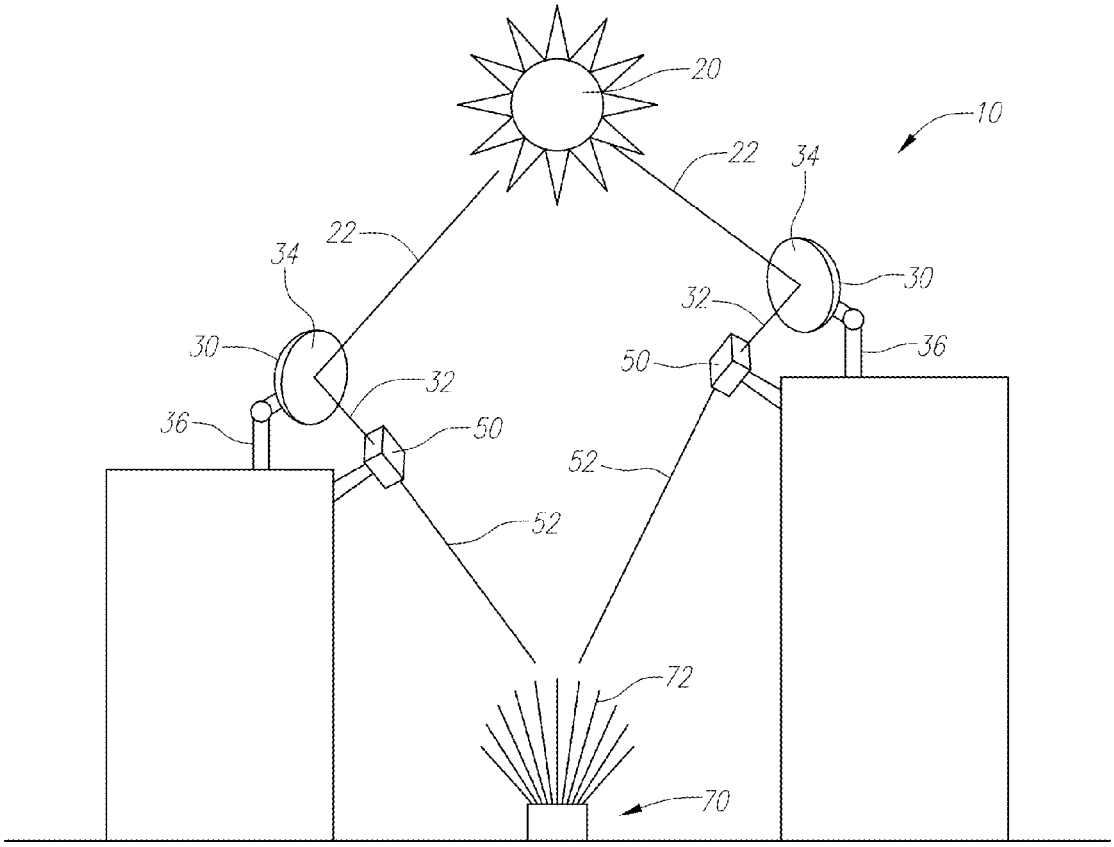
FIG. 2 is a system diagram of an alternate embodiment of the current invention using sunlight, multiple heliostats and multiple color filters to illuminate a water display.

System 10 may also incorporate a several heliostats 30 in order to direct multiple beams of reflected sunlight 32 onto a several color filters 50 as shown in FIG. 2. Accordingly, water 72 in water display 70 may be illuminated with greater intensity. In this manner, water 72 in water display 70 may also be illuminated with the same color from each of the multiple color filters 50, or from various different colors emitting from various color filters 50 simultaneously, in an orchestrated rotating fashion, or in other choreographed programs. For example, one heliostat 30 may reflect sunlight 32 through a color filter 50 that emits the color red, and another heliostat 30 may reflect sunlight 32 through another color filter 50 that emits the color blue. Thus it may follow that the water 72 within the water display 70 may be illuminated with the color red and the color blue simultaneously, with the color red only (while the output of the color filter 50 that emits blue light may be closed), with the color blue only (while the output of the color filter 50 that emits red light may be closed), or with the colors red and blue in an orchestrated fashion.

While FIG. 2 shows the system 10 as having two sets of heliostats 30 and color filters 50, system 10 may have more heliostats 30 and filters 50. Also, while FIG. 2 depicts the heliostats 30 and color filters 50 to be stationed on different buildings or structures, they may be stationed on the same structure, or depending on the number of heliostats 30 and filters 50, on a combination of the same and different structures. An increased number of heliostats may be desired to fully capture sunlight over the course of the day. That is, certain heliostats may be positioned such that they may not optimally capture and reflect sunlight 22. Where this is the case, other heliostats may be better positioned to capture and reflect sunlight 22 during different portions of the day.

Figure 1A:
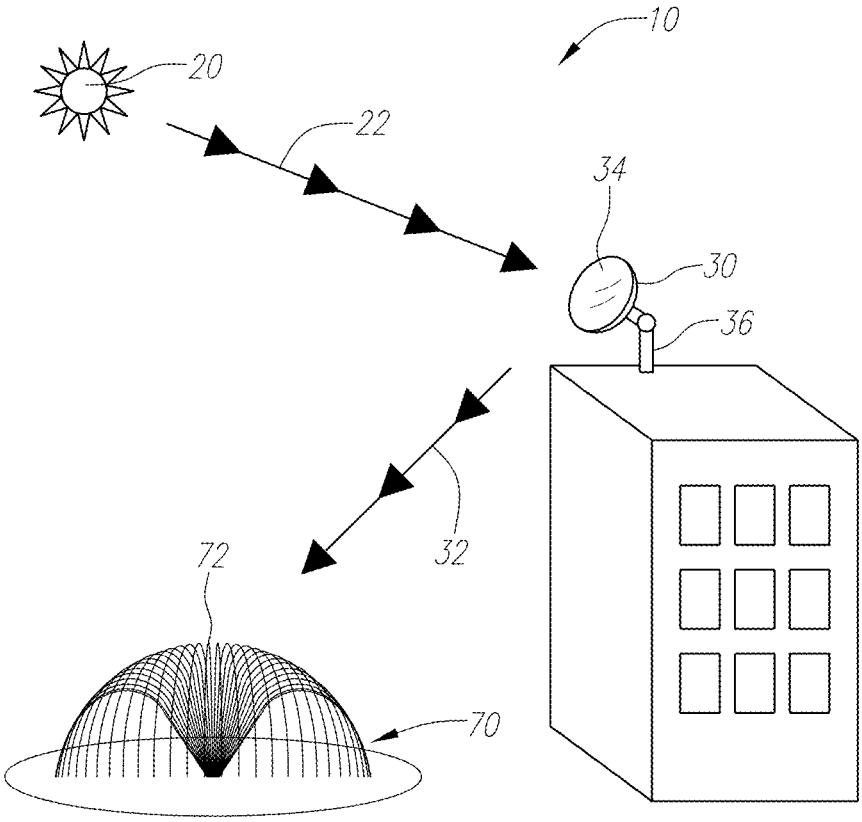
FIG. 1A is a system diagram of an embodiment of the current invention using sunlight and a heliostat to illuminate a water display.

It should be noted that system 10 as described above with reference to FIG. 1 may not include a color filter 50, as depicted in FIG. 1A. Accordingly, reflected light 32 off of the heliostat 30 may be directed onto the water 72 of water fountain 70 in its generally natural white light form. This reflected light 32 may add intensity to the natural white light that may be shining onto the water display directly from the sun and may further illuminate the water 72. In addition, if the fountain 70 is not lit by direct sunlight, for instance in the case where the fountain 70 may be positioned in the shade, the reflected light 32 from heliostat 30 may noticeably illuminate the water 72 within the water display 70.

While FIG. 1A depicts the water display 70 as being illuminated by one heliostat 30, other numbers of heliostats 30 may also be used to further illuminate the water display 70 with even greater intensity. As a result, the water 72 illuminated by a multitude of heliostats 30 may appear to be glowing or to be a white phosphorescent liquid.

Figure 3:
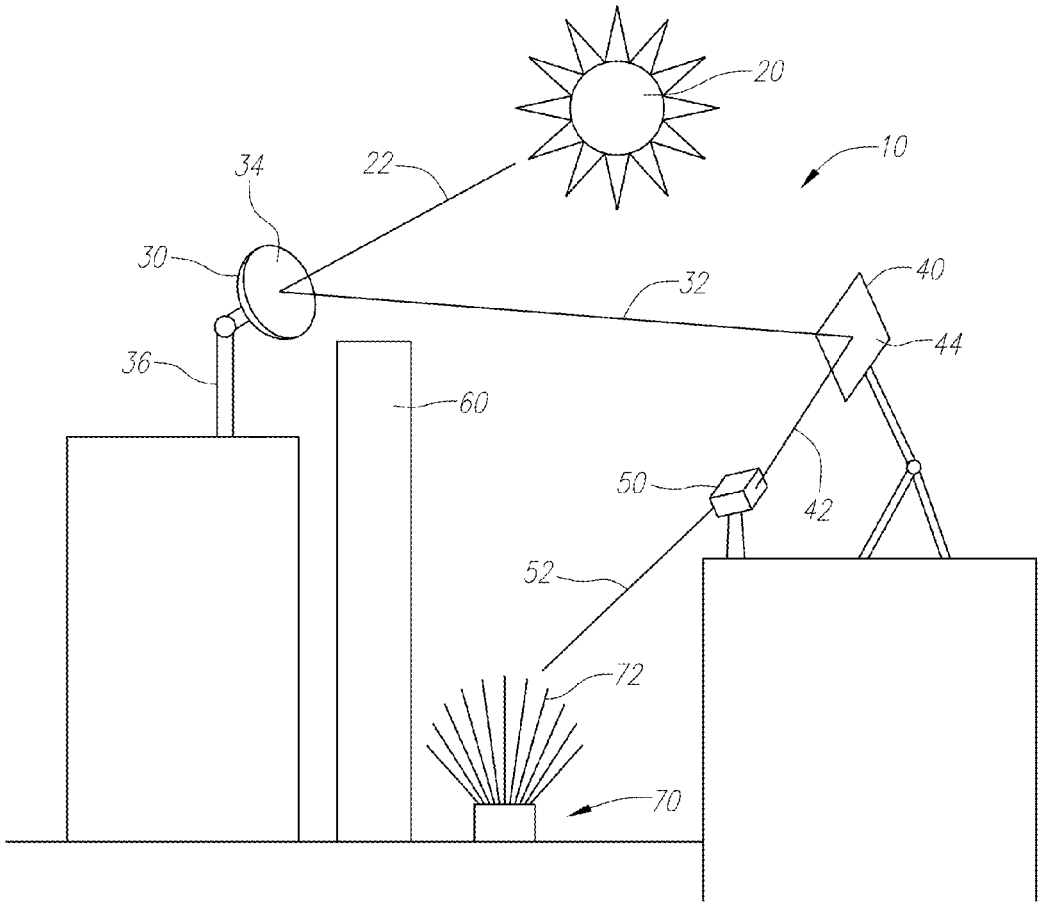
FIG. 3 is a system diagram of an alternate embodiment of the current invention using sunlight, a heliostat, a reflector and a color filter positioned after the reflector to illuminate a water display.

In another embodiment of system 10 depicted in FIG. 3, reflector 40 may be used to reflect and generally redirect the reflected light 32 from the heliostat 30 onto a colored filter 50. This may be preferable in the scenario where there may not be a straight line of site between the heliostat 30 and the target point on the water fountain 70. This may occur in city environments where multiple tall buildings surround the system 10. For example, as depicted in FIG. 3, structure 60 may block the line of site from the mirror 34 on heliostat 30 to the water fountain 70. Because of structure 60, heliostat 30 would not alone be able to illuminate the fountain 70.

Accordingly, reflector 40 may be positioned to establish a line of site with the heliostat 30 to receive reflected light 32, and to also have a line of site with the water 72 in the water display 70. This way, reflector 40 may receive reflected light 32 from the heliostat 30, and may reflect light 42 through color filter 50 which in turn may emit filtered light 52 onto the water display 70.

Reflector 40 may comprise of a mirror 44 that may be flat, such as a plane mirror. Accordingly, reflected sunlight 42 may reflect off the mirror 44 at a reflection angle that is equal to the incident angle of reflected light 32 directed onto the mirror 44 by the heliostat 30. Because the reflected light 32 coming from the heliostat 30 may be collimated with parallel rays, and the reflector mirror 44 may be planar, the reflected light 42 may remain collimated. This is advantageous for system 10 because much of the original intensity of sunlight 22 remains available to illuminate water 72.

Figure 3A:
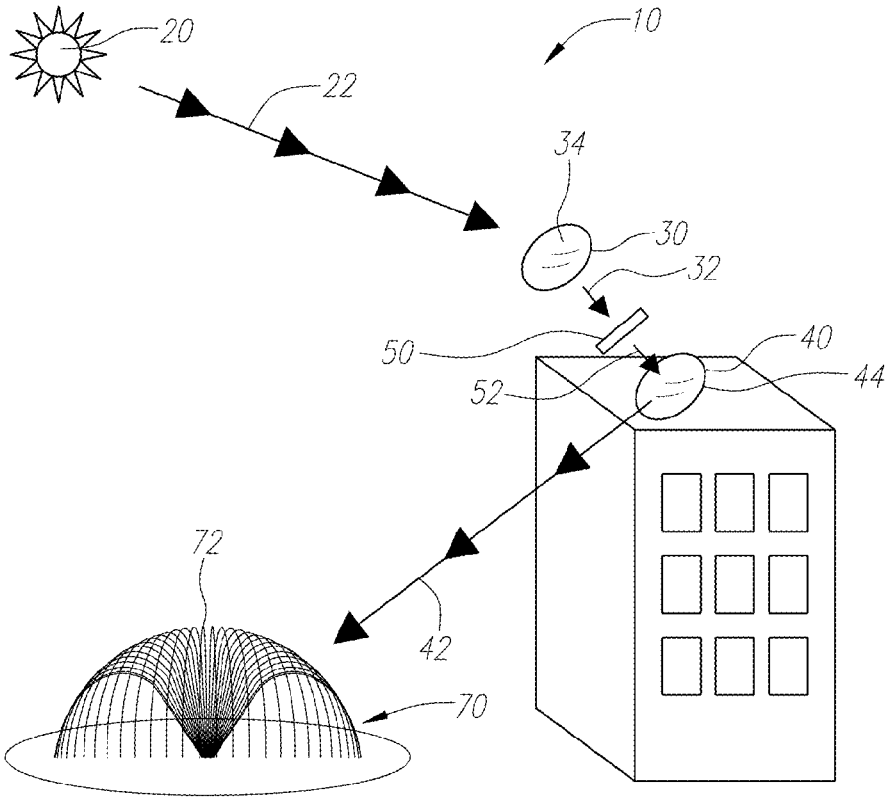
FIG. 3A is a system diagram of an alternate embodiment of the current invention using sunlight, a heliostat, a reflector and a color filter positioned after the heliostat to illuminate a water display.

It should be noted that the color filter 50 may be positioned between the heliostat 30 and the reflector 40 instead of after the reflector 40 as described above. This positioning of the color filter 50 after the heliostat 30 and before the reflector 40 is shown in FIG. 3A. With this positioning, reflected light 32 from the heliostat 30 may be directed through the color filter 50, and filtered light 52 emitted from the color filter 50 may be directed onto the reflector 40. Reflected light 42 from the reflector 40, which may now be colored because it may have passed through the color filter 50, may be directed onto the water 72 of the water display 70.

As with the embodiment of system 10 described in previous sections, these embodiments of system 10 that include a reflector 40 may include a multitude of heliostats 30, reflectors 40 and color filters 50 that may illuminate the water display 70 in a variety of colors and intensities in an orchestrated fashion.

Figure 3B:
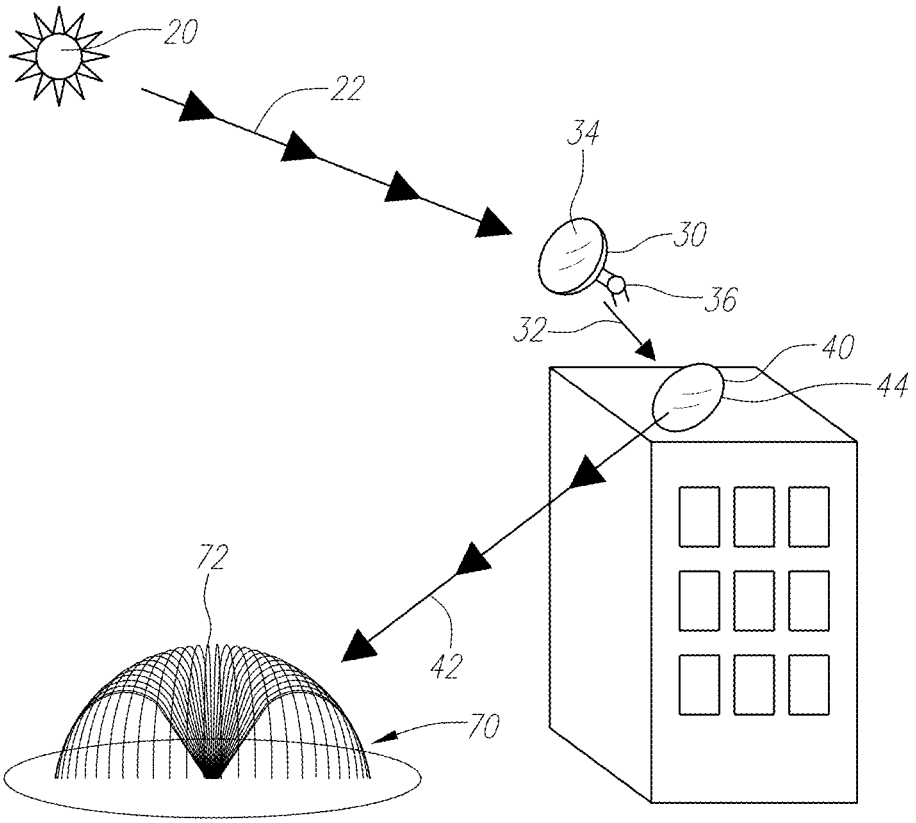
FIG. 3B is a system diagram of an alternate embodiment of the current invention using sunlight, a heliostat and a reflector to illuminate a water display.

In addition, it should also be noted that system 10 as described above with reference to FIG. 3 and FIG. 3A may not include a color filter 50. This is depicted in FIG. 3B. Accordingly, reflected light 32 off of the heliostat 30 may be directed onto the mirror 44 of the reflector 40 in its generally natural white light form. Reflected light 42, which may also be in its generally natural white light form, may be directed onto the water 72 of water display 70. This reflected light 42 may add intensity to the natural white light that may be shining onto the water display directly from the sun and may further illuminate the water 72.

In addition, if the fountain 70 is not lit by direct sunlight, for instance in the case where the fountain 70 may be positioned in the shade, the reflected light 42 from reflector 40 may noticeably illuminate the water 72 within the water display 70. While FIG. 3B depicts the water display 70 as being illuminated by one heliostat 30 and one reflector 40, other numbers of heliostats 30 and reflectors 40 may also be used. As a result, the water 72 illuminated by a multitude of heliostats 30 and a multitude of reflectors 40 may appear to be glowing or to be a white phosphorescent liquid.

Figure 4:
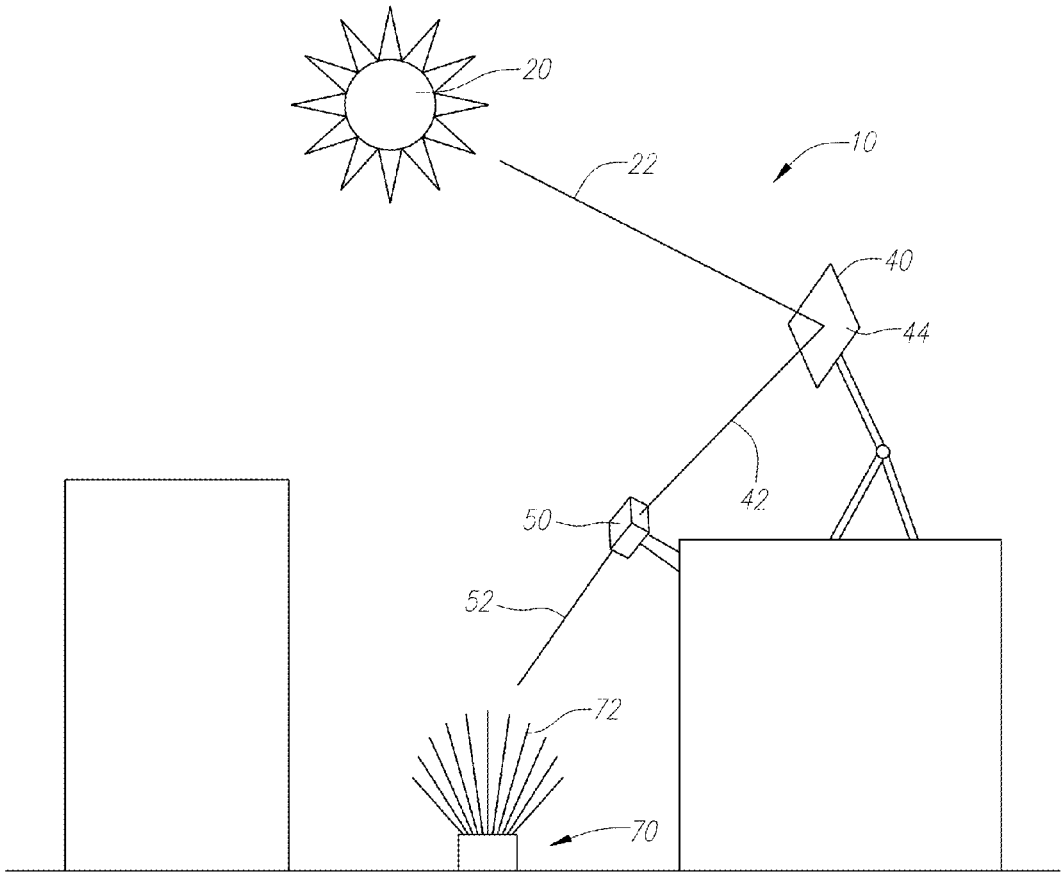
FIG. 4 is a system diagram of an alternate embodiment of the current invention using sunlight, a reflector and a color filter to illuminate a water display.

In yet another embodiment of system 10 as depicted in FIG. 4, a heliostat 30 may not be included and the reflector 40 may solely be used to reflect and redirect the sunlight 22 through the color filter 50 and onto the water display 70. In this scenario, reflector 40 may be positioned to reflect the sunlight 22 through color filter 50 and onto the water display 70 for a particular position of the sun 20 in the sky which may occur at a particular time of day when the illumination of the water display 70 is desired.

As with the embodiment of system 10 describe in previous sections, this embodiment of system 10 that includes a reflector 40 and not a heliostat 30 may include a number reflectors 40 and color filters 50 that may illuminate the water display 70 in a variety of colors and intensities in an orchestrated fashion.

In addition, it should also be noted that system 10 as described above with reference to FIG. 4 may not include a color filter 50. This is depicted in FIG. 4B. Accordingly, reflected light 42 off of the reflector 40 may be directed onto the water 72 in the water fountain 70 in its generally natural white light form. This reflected light 42 may add intensity to the natural white light that may be shining onto the water display directly from the sun and may further illuminate the water 72.

Also, if the fountain 70 is not lit by direct sunlight, for instance in the case where the fountain 70 may be positioned in the shade, the reflected light 42 from reflector 40 may noticeably illuminate the water 72 within the water display 70. While FIG. 4B depicts the water display 70 as being illuminated by one reflector 40, other numbers of reflectors 40 may also be used. As a result, the water 72 illuminated by a multitude of reflectors 40 may appear to be glowing or to be a white phosphorescent liquid.

Figure 5:
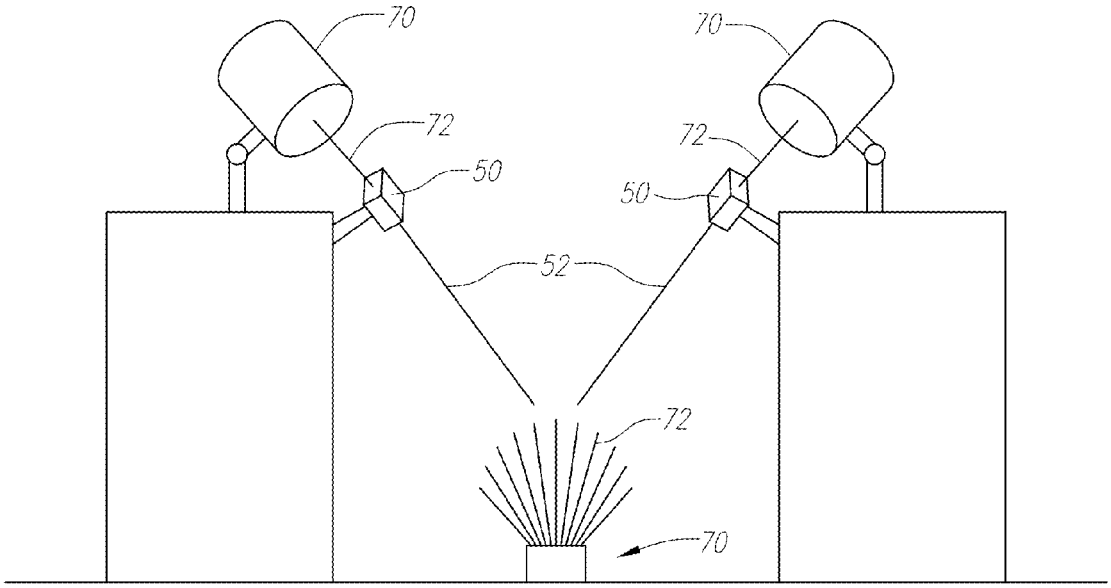
FIG. 5 is a system diagram of an alternate embodiment of the current invention using artificial light.

An alternative embodiment of the current invention where artificial light may be used to illuminate a water display is now described with reference to FIG. 5. As depicted in FIG. 5, one or more artificial light sources 80 may be positioned to emit light 82 through color filters 50 which may in turn emit colored light 52 onto water 72 within a water display 70. While FIG. 5 depicts the use of two artificial light sources 80, a single light source 80 may be used, or multiple light sources 80 may be used. It may be preferable that artificial light sources 80 be very bright with high intensity outputs such as xenon spotlights or other types of bright light sources. If the artificial light sources 80 have a straight line of site to the water display 70 that they are intended to illuminate, there may be no need for the use of reflectors 40 (not shown) as described in previous embodiments. However, if the artificial light sources 80 do not have a straight line of site to the to the water display 70 that they are intended to illuminate, the use of reflectors 40 (not shown) as described in previous embodiments may be required.

As with the embodiments of system 10 described in previous sections, this embodiment of system 10 that includes an artificial light source 80 may include a number of light sources 80, reflectors 40 and color filters 50 that may illuminate the water display 70 in a variety of colors and intensities in an orchestrated fashion.

In all of the embodiments described above, the addition of a lens 90 in the path of light between the sun 20 and the water display 70 may further focus the light into a tighter beam which may add additional intensity to the illumination of the water display 70. This will now be described in further detail with regards to the embodiment of FIG. 1 described earlier.

Figure 8:
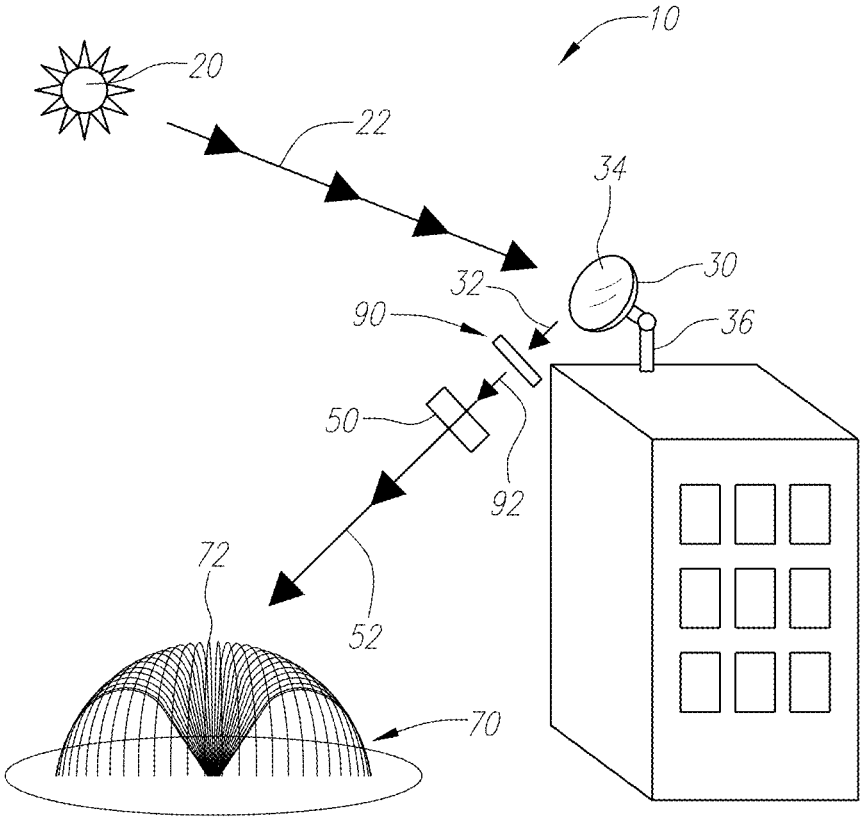
FIG. 8 is a system diagram of an embodiment of the current invention using sunlight, a heliostat, a lens and a color filter to illuminate a water display.

FIG. 8 depicts a lens 90 placed in the path of light in system 10 after the heliostat 30 and before color filter 50. Collimated light 22 from the sun 20 may reflect off of the heliostat 30 and become reflected light 32 which may then pass through the lens 90 and become focused light 92. In a preferred embodiment, lens 90 may refract the generally collimated reflected light 32 and may cause it to converge into a focused beam 92. Accordingly, it may be preferable that lens 90 be a convex lens, a biconvex lens, a Fresnel lens or another type of lens that may converge the light rather than diverge it.

It may be preferable that the axis of lens 90 be parallel to the line of sight between the mirror 34 of the heliostat 30 and the target water display 70. Following optical theory, in this configuration collimated reflected light 32 may travel parallel to the axis of lens 90, may pass through lens 90 and may be converged or focused to a spot on the axis of lens 90 at a certain position on the line of site between the lens 90 and the target water display 70. This spot is known as the focal point of the lens 90, and the distance between the lens 90 and its focal point is known as the focal length. It may be preferable that lens 90 be chosen to have a focal point that may generally coincide with the target water display 70 such that focused light 92 may be focused directly onto the water 72 of the water display 70 thus adding generally optimized intensity to the illumination of the display 70. In other words, it may be preferable for the distance between the lens 90 and the water display 70 to generally equal the focal length of lens 90.

It may also be preferable that the color filter 50 that may be in the path between the lens 90 and the water display 70 not disturb or otherwise alter the desired focal point and focal length of the lens 90.

While FIG. 8 depicts the lens 90 being place in a position between the heliostat 30 and the color filter 50, lens 90 may also be placed in other positions with similar results. For example, lens 90 may be placed between the color filter 50 and the water display 70.

In addition, while the above description with reference to FIG. 8 describes the addition of a lens 90 to the system 10 particular to the earlier embodiment of FIG. 1, it is clear that a lens 90 may be added to any and all of the embodiments of system 10 described in earlier and ensuing sections with similar results and effects.

Figure 9:
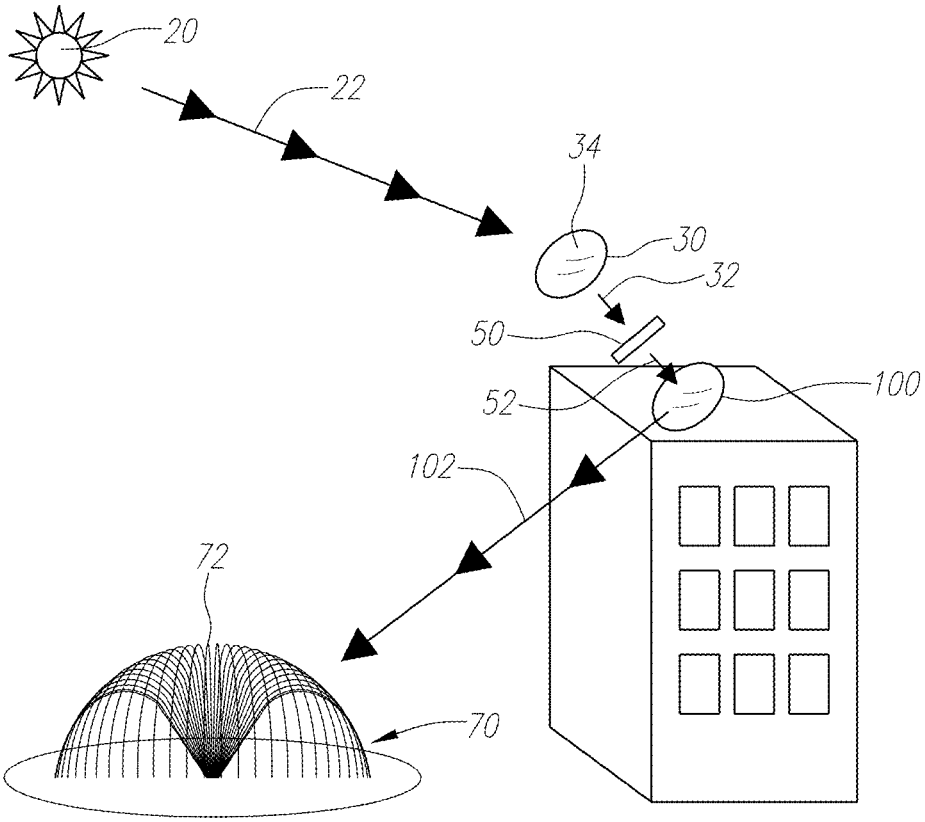
FIG. 9 is a system diagram of an alternate embodiment of the current invention using sunlight, a heliostat, a prism and a color filter positioned after the heliostat to illuminate a water display.

It should also be noted that in all of the embodiments of system 10 described in earlier sections that include a reflector 40, a prism 100 may be used instead of or in conjunction with the reflector 40. For example, FIG. 9 depicts an embodiment described earlier with reference to FIG. 3A but with a prism 100 instead of a reflector 40. In FIG. 9, colored light 52 may reflect off of prism 100 to become reflected light 102 which may then be directed to illuminate the water display 70. It may be preferable that prism 100 be a reflective prism that implements total internal reflection to maximize the amount of colored light 52 that may be reflected and redirected by prism 100 onto the water display 70.

While the above description with reference to FIG. 9 describes the substitution of a prism 100 for the reflector in the system 10 particular to the earlier embodiment of FIG. 3A, it is clear that a prism 100 may be substituted for a reflector 40 or added to operate in conjunction with a reflector 40 in any and all of the embodiments of system 10 described in earlier and ensuing sections with similar results and effects.

Also, while the embodiments of system 10 as described above depict the water 72 of a single water display 70 being illuminated by the system 10, system 10 may be configured to illuminate more than one water display 10 at a given time. This may occur through the strategic placement of the components described above.

System 10 may also be controlled remotely using a computer or other control device. To this end, it may be preferred that the control device control the alignment of the heliostats 30 with the sun 20 as described in above sections, as well as control any switching means that may be necessary to switch the color filters 50 in and out to determine the color of the light that may illuminate the water display as discussed in earlier sections. The control device may include software that allows for the automated control of these devices. These devices may also be manually controlled. Alternatively, a combination of automated and manual control may occur.

The manner in which water display 70 may provide the visual effects due to system 10 of the current invention is now discussed with reference to FIGS. 6A-6C and FIGS. 7A-7G. These figures are actual depictions of water 72 that has been illuminated with different colors during that are clearly discernable in broad daylight.

Figure 6C:
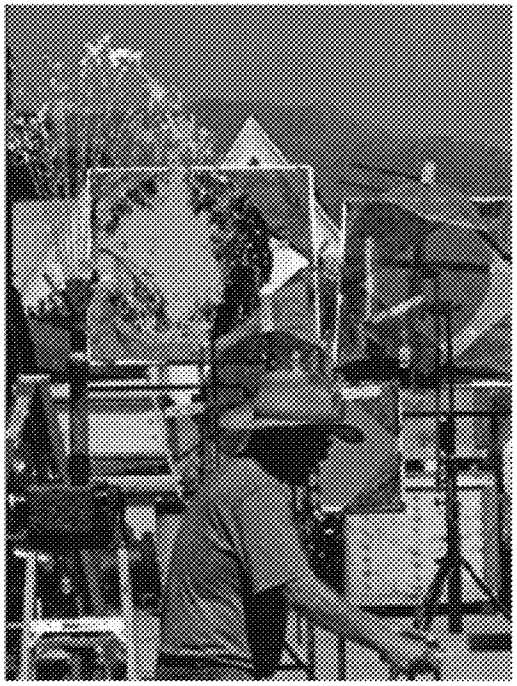
FIGS. 6A, 6B and 6C show the manner in which water may be illuminated during the daytime.
Figure 6B:
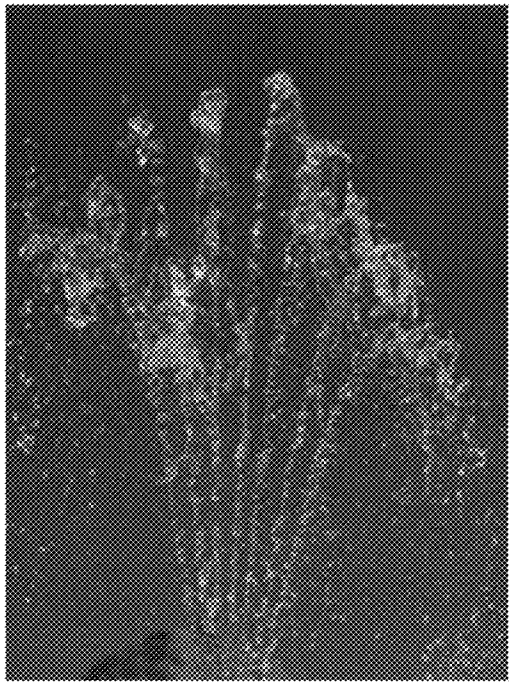
Figure 6A:
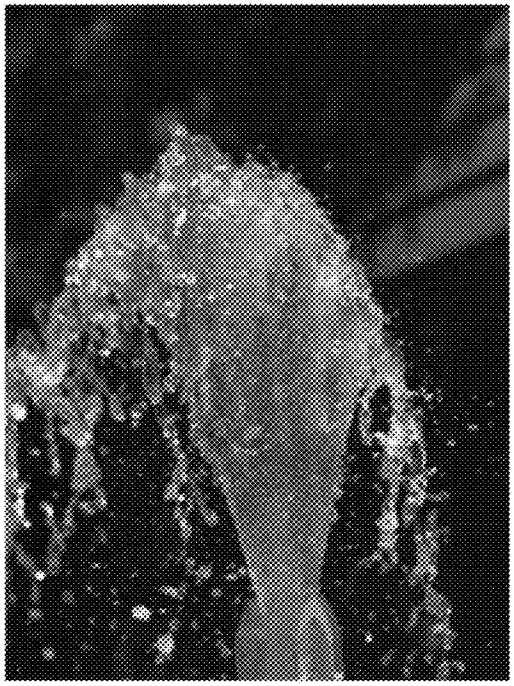
Figure 7A:
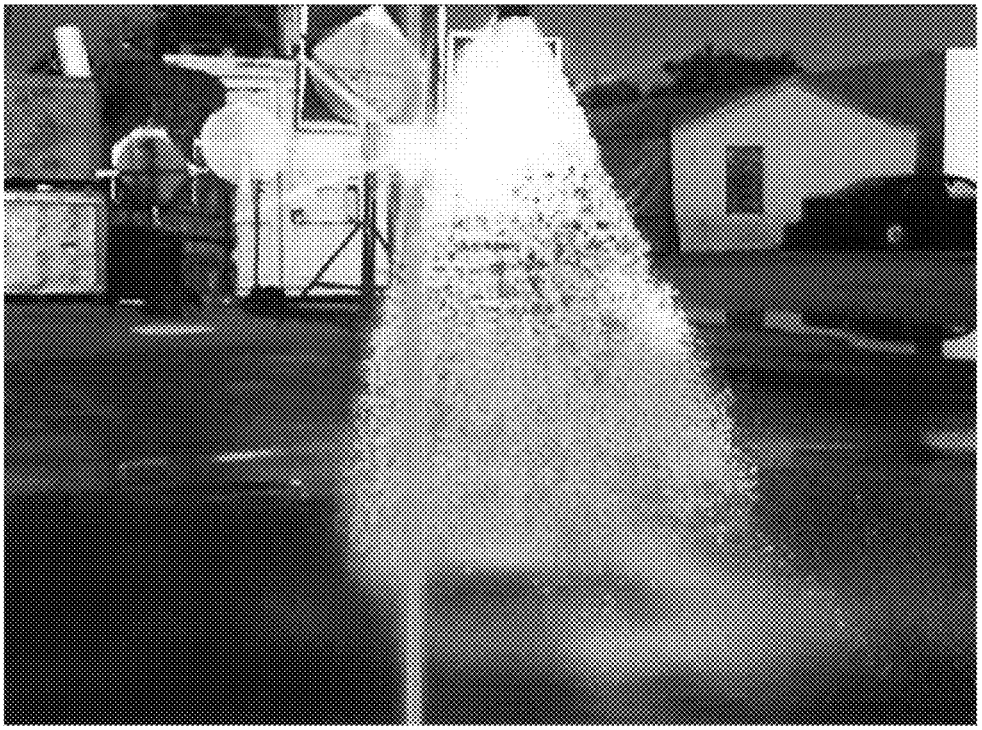
FIGS. 7A-7G show the manner in which water may be illuminated during the daytime.
Figure 7B:
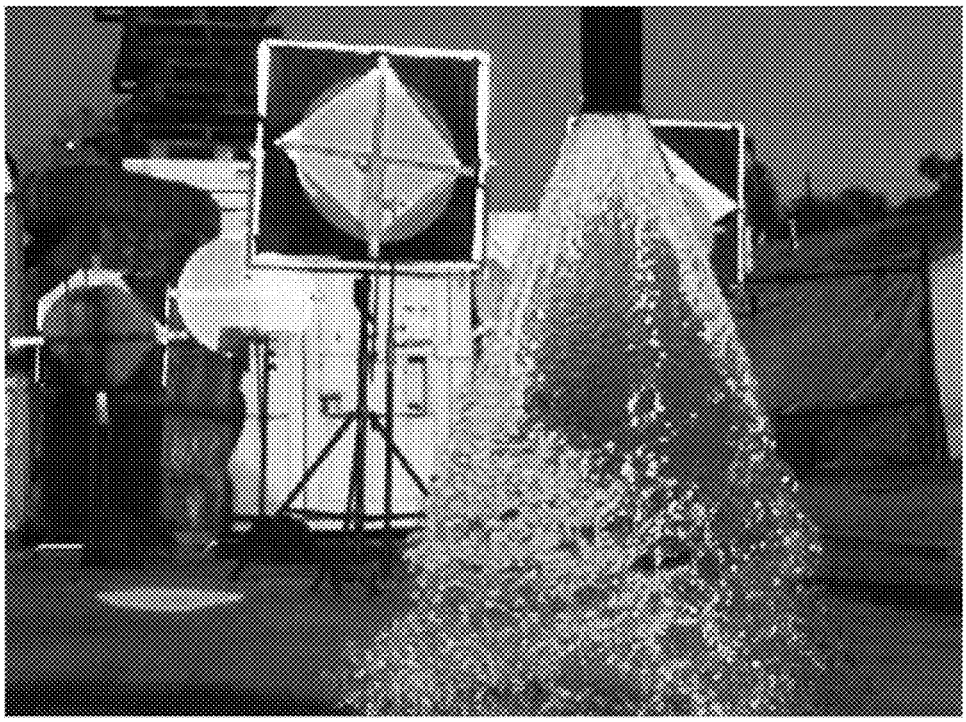
Figure 7C:
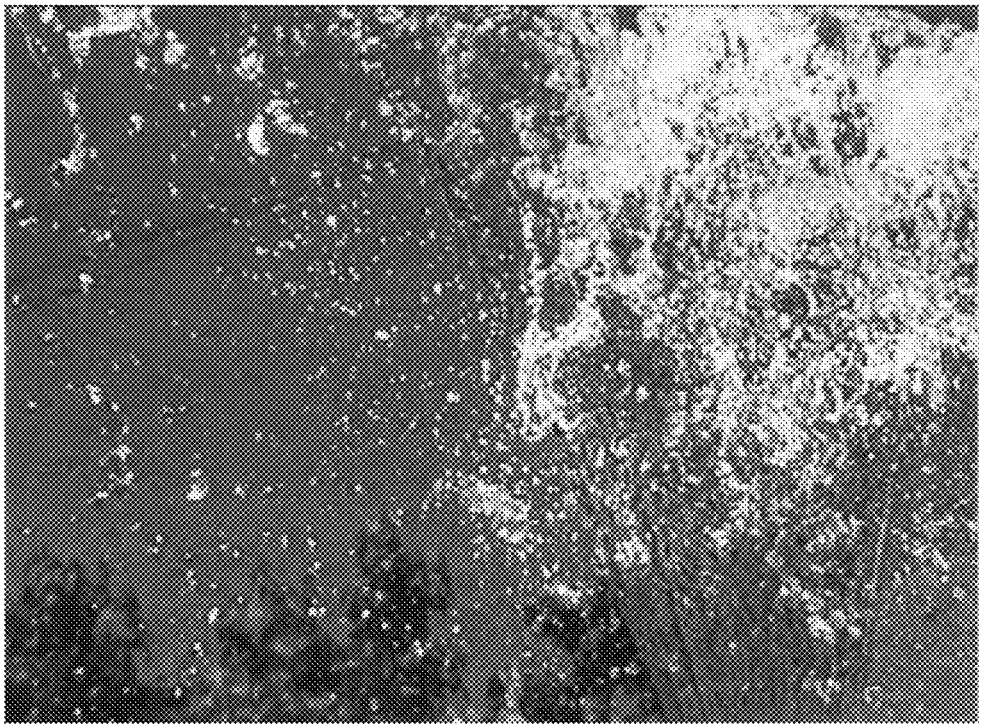
Figure 7D:
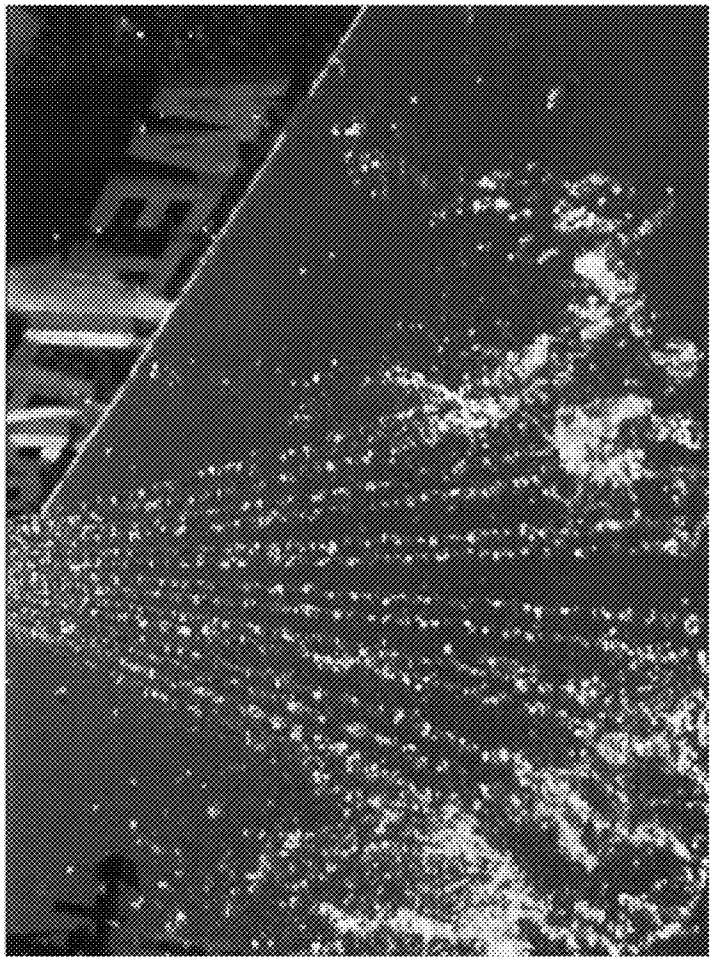
Figure 7E:
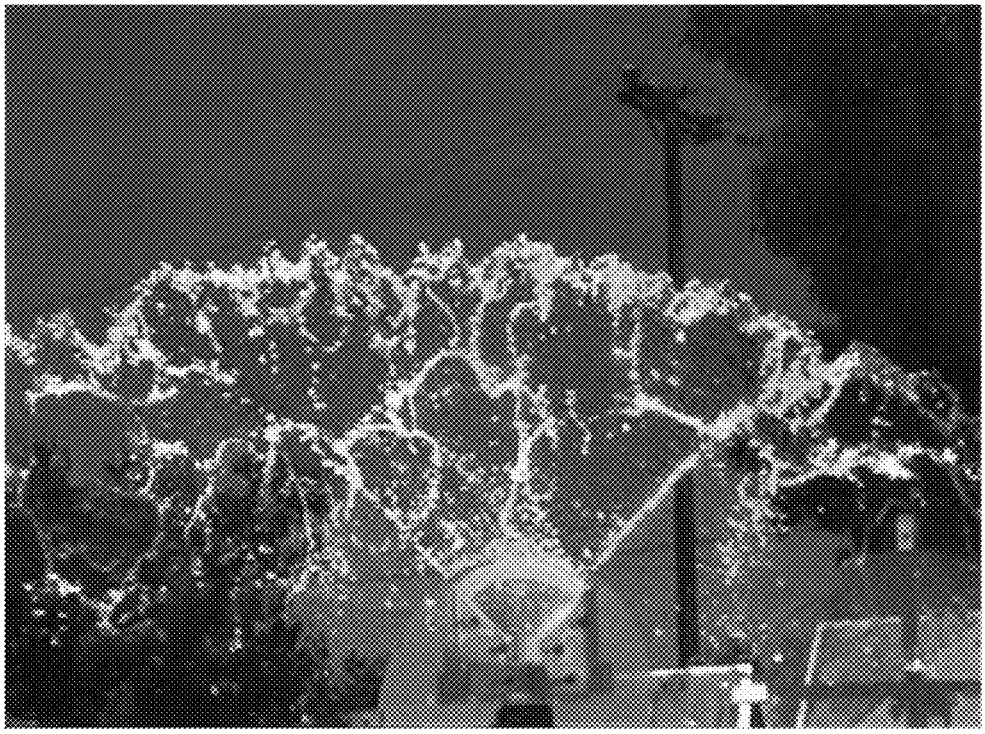
Figure 7F:
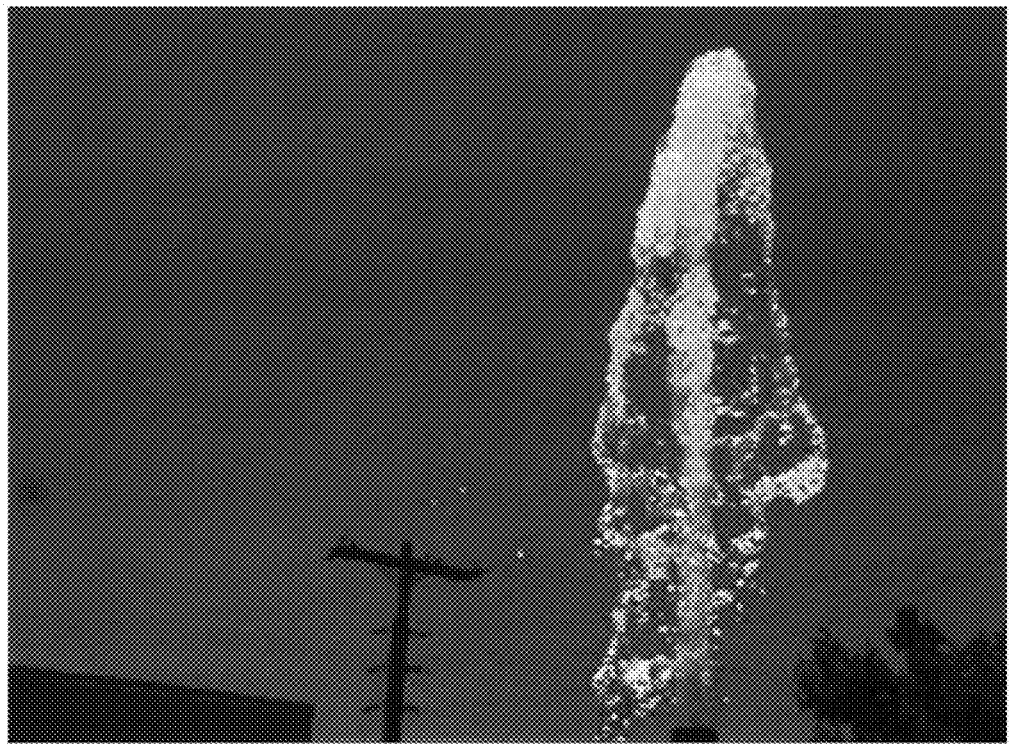
Figure 7G:
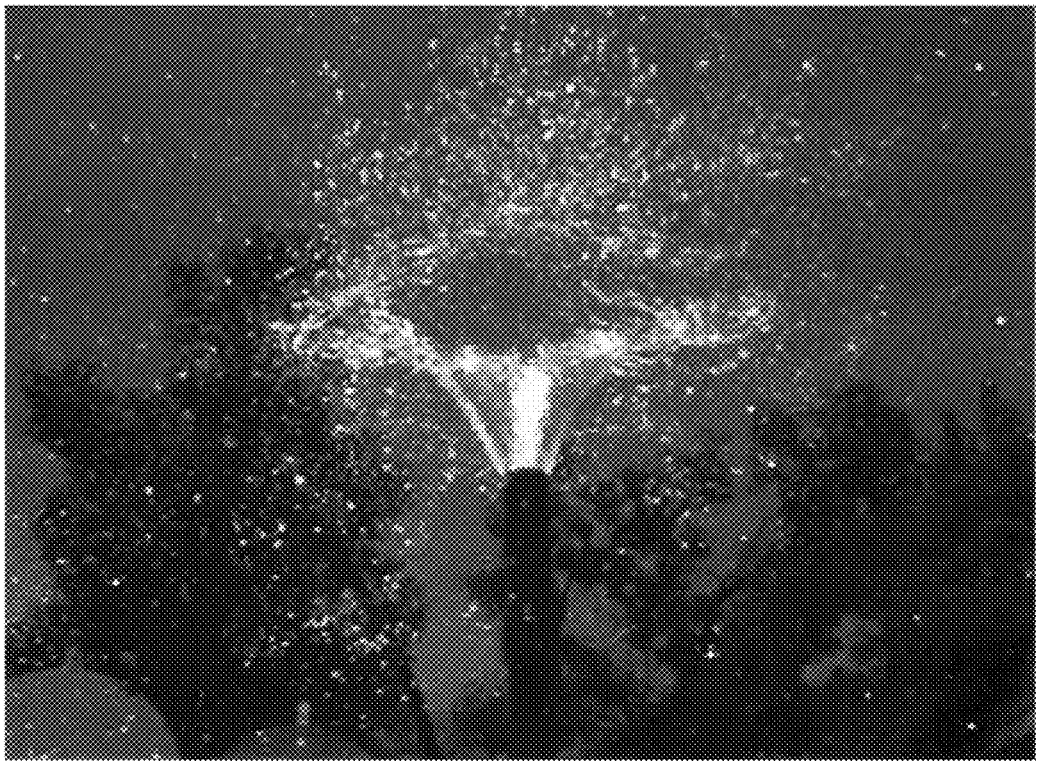

As shown in FIGS. 6A-6C, and as shown in FIGS. 7A, 7B, 7E, 7F and 7G, water emitted from a water delivery device 74 during the daytime may be illuminated with colors such as purple, aqua and other colors. FIG. 6C again shows how water 72 emitted by a water delivery device 74 in the middle of the day may be illuminated with different colors. To this end, the color filter used to provide this illumination is also shown. The mountains in the background should be noted as they confirm that water 72 is being illuminated in the broad daylight.

FIGS. 7A-7G provide a number of pictures where water 72 is again illuminated during broad daylight. To this end, it should be noted how the blue sky in the background of many of these pictures confirms how the water is discernibly illuminated in the middle of the day. Trees, buildings telephone poles and other items are clearly visible in several of these figures, again confirming how water 72 may intensely illuminated.

Although certain presently preferred embodiments of the invention have been described herein, it will be apparent to those skilled in the art to which the invention pertains that variations and modifications of the described embodiments may be made without departing from the spirit and scope of the invention.

What is claimed is:

1. An outside water display having a decorative lighting effect during daytime, comprising:

a water delivery device that is located outside of a building;

at least one stream of water emitted by the water delivery device;

a first reflective surface that is positioned such that it does not have a direct line of sight to the water delivery device, and that is configured to receive light directly from the sun without physical obstruction other than the atmosphere, that is planar and that reflects the light in substantially collimated form;

a second reflective surface that is configured to receive light directly from the first reflective surface; and a color filter that is located outside the water delivery device, that is configured to receive light from the second reflective surface and that transmits only a desired color or range of colors in substantially collimated form;

wherein the desired color or range of colors transmitted by the color filter is directed to the at least one stream of emitted water in the water display through the air thereby illuminating the at least one stream of emitted water with the desired color or range of colors thereby providing a decorative lighting effect on the emitted water during daytime.

2. The water display of claim 1, further comprising a lens that focuses the substantially collimated light to the emitted water.

3. The water display of claim 2, wherein the focused light transmitted to the emitted water is more intense than the surrounding sunlight.

4. The water display of claim 1, wherein the first reflective surface comprises a heliostat that tracks the movement of the sun during at least a portion of the day and that reflects substantially collimated light to the second reflective surface.

5. The water display of claim 4, wherein the water display includes two or more heliostats that are positioned to track the movement of the sun and that reflect substantially collimated light.

6. The water display of claim 4, wherein the position of the heliostat is controlled by a computer or other controller.

7. The water display of claim 1, wherein the second reflective surface comprises a mirror or prism that is positioned to redirect the light in substantially collimated form to the color filter.

8. The water display of claim 1, further comprising a lens that focuses the substantially collimated light from the color filter.

9. The water display of claim 8, wherein the lens is positioned between the filter and the at least one stream of emitted water.

10. The water display of claim 9, wherein the lens focuses the substantially collimated light from the color filter to a focal point that substantially coincides with at least some of the water in the at least one stream of emitted water.

11. The water display of claim 1, wherein the substantially collimated light transmitted by the color filter is a visible color.

12. An outside water display, comprising:

a water delivery device that is located outside of a building;

at least one stream of water emitted by the water delivery device;

a first reflective surface that is positioned such that it does not have a direct line of sight to the water delivery device, and that is configured to receive light directly from the sun without obstruction other than the atmosphere, that is planar and that reflects light in substantially collimated form;

a second reflective surface that is configured to receive light directly from the first reflective surface; and a color filter which is located outside the water delivery device, which is positioned to receive light from the second reflective surface and which transmits a desired color of light in substantially collimated form to the at least one stream of emitted water through the air;

wherein the at least one stream of emitted water in the water display receives the desired color of transmitted light and is illuminated during daytime in a decorative fashion thereby.

13. The water display of claim 12, further comprising a lens that focuses the substantially collimated light from the color filter to the at least one stream of emitted water.

14. The water display of claim 13, wherein the lens is positioned between the color filter and the at least one stream of emitted water.

15. The water display of claim 13, wherein the lens focuses the substantially collimated light to a focal point that substantially coincides with at least some of the at least one stream of emitted water.

16. The water display of claim 15, wherein the color filter transmits the desired color so that the illumination is a visible color.

17. The water display of claim 12, wherein the color filter comprises a plurality of color filters.

18. The water display of claim 12, wherein the first reflective surface is mounted on a building.

19. The water display of claim 18, wherein the at least one stream of emitted water is located at the base of the building, and the color filter is positioned to receive the substantially collimated light from the second reflective surface and transmit the desired color of light to the at least one stream of emitted water at the base of the building.

* * * * *